US009888544B2

(12) United States Patent
Su et al.

(10) Patent No.: US 9,888,544 B2
(45) Date of Patent: Feb. 6, 2018

(54) DRIVING CIRCUITS AND METHODS FOR CONTROLLING LIGHT SOURCE

(71) Applicant: O2Micro Inc., Santa Clara, CA (US)

(72) Inventors: Xinhe Su, Sichuan (CN); Juan Zhao, Sichuan (CN); Ching-Chuan Kuo, Taipei (TW)

(73) Assignee: O2Micro Inc., Santa Clara, CA (US)

( * ) Notice: Subject to any disclaimer, the term of this patent is extended or adjusted under 35 U.S.C. 154(b) by 51 days.

(21) Appl. No.: 14/968,209

(22) Filed: Dec. 14, 2015

(65) Prior Publication Data

US 2016/0192456 A1 Jun. 30, 2016

(30) Foreign Application Priority Data

Dec. 26, 2014 (CN) ..... 2014 1 0834789

(51) Int. Cl.
*H05B 33/08* (2006.01)

(52) U.S. Cl.
CPC ..... *H05B 33/0887* (2013.01); *H05B 33/0815* (2013.01)

(58) Field of Classification Search
CPC ..... H05B 33/0887; H05B 33/0815
See application file for complete search history.

(56) References Cited

U.S. PATENT DOCUMENTS 5,500,792 A * 3/1996 Jeon ..... H02M 7/53803 315/190
2004/0145924 A1* 7/2004 Jang ..... H02M 1/36 363/20
2006/0197470 A1* 9/2006 Ribarich ..... H05B 41/2885 315/291
2011/0285324 A1* 11/2011 Kao ..... H05B 33/0809 315/309
2012/0274247 A1* 11/2012 Zhao ..... H02P 6/20 318/400.01
2014/0167643 A1* 6/2014 Motabar ..... H05B 33/0806 315/297
2015/0015143 A1* 1/2015 Inada ..... H05B 33/0815 315/77
2015/0069908 A1* 3/2015 Fukui ..... H05B 33/0815 315/82
2015/0180355 A1* 6/2015 Freeman ..... H02M 1/08 363/21.04

* cited by examiner

*Primary Examiner* — Alexander H Taningco
*Assistant Examiner* — Kurtis R Bahr

(57) ABSTRACT

A method for powering a load by a light source driving circuit is disclosed. The method includes: acquiring a first sensing signal indicative of an average current flowing through the load; generating a first temperature detecting signal indicative of an ambient temperature of the light source driving circuit; and adjusting the average current flowing through the load based on the first temperature detecting signal and the first sensing signal to make the average current flowing through the load to be inversely proportional to the ambient temperature of the light source driving circuit if the ambient temperature of the light source driving circuit is between a first temperature threshold and a second temperature threshold.

17 Claims, 8 Drawing Sheets

DRIVING CIRCUITS AND METHODS FOR CONTROLLING LIGHT SOURCE

RELATED APPLICATION

This application claims priority to Chinese Patent Application No. 201410834786.7, filed on Dec. 26, 2014, with the State Intellectual Property Office of the People's Republic of China, incorporated by reference in its entirety herein.

FIELD

The present teaching relates generally to light source driving circuits and in particular to driving circuits and methods for adjusting power supplied to loads based on ambient temperature.

BACKGROUND ART

Compared with traditional filament lights, LED (light emitting diode) light sources possess advantages such as environmental protection, energy savings, relatively high luminous efficiency, and long life. Thus, replacing filament lights with LED light sources is an inevitable trend based on current developments. LED bulbs are types of LED lights that are similar in shape and size to filament lights. An LED bulb includes an LED light source and a control chip. LED light sources require temperature controls as overheating will shorten their life. Yet the closed architecture of LED bulbs makes heat dissipation difficult. The high temperature may easily damage the control chip in the LED light source. Therefore, there exists a need to provide a solution to effectively manage the temperature of LED bulbs.

SUMMARY

In a first embodiment according to present invention, a light source driving circuit is disclosed. The light source driving circuit includes a power converter and a controller. The power converter is configured for receiving input voltage and providing output power to a load. The controller, coupled to the power converter, is configured for acquiring a first sensing signal indicative of an average current flowing through the load, generating a first temperature detecting signal indicative of ambient temperature of the light source driving circuit, and adjusting the average current flowing through the load based on the first temperature detecting signal and the first sensing signal. The controller decreases the average current of the load based on the first temperature detecting signal and the first sensing signal when the ambient temperature keeps rising after the ambient temperature rises above a first temperature threshold.

In a second embodiment according to the present invention, a controller for controlling ambient temperature of a light source driving circuit having a power converter is disclosed. The power converter is configured for receiving input voltage and supplying power to a load. The controller includes a sensing terminal, a compensation terminal and a driving terminal. The sensing terminal is configured for receiving a sensing signal indicative of an instant current flowing through the load. The compensation terminal is configured for generating an error signal based on the instant current sensing signal and a first temperature detecting signal indicative of the ambient temperature of the light source driving circuit. The driving terminal is configured for generating a driving signal based on the error signal to control the power converter, so as to adjust an average current flowing through the load. The driving signal decreases the average current flowing through the load when the ambient temperature keeps rising after the ambient temperature of the light source driving circuit rises above a first temperature threshold.

In a third embodiment of the present invention, a method for powering a load by a light source driving circuit having a power converter is disclosed. The method includes steps of: acquiring a first sensing signal indicative of an average current flowing through the load; generating a first temperature detecting signal indicative of an ambient temperature of the light source driving circuit; and adjusting the average current flowing through the load based on the first temperature detecting signal and the first sensing signal to make the average current flowing through the load inversely proportional to the ambient temperature of the light source driving circuit when the ambient temperature of the light source driving circuit is between a first temperature threshold and a second temperature threshold which is greater the first temperature threshold.

BRIEF DESCRIPTION OF THE DRAWINGS

Features and advantages of embodiments according to the invention will become apparent as the following detailed description proceeds, and upon reference to the drawings, where like numerals depict like elements, and in which.

DETAILED DESCRIPTION

Reference will now be made in detail to embodiments according to the present invention. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be recognized by one of ordinary skill in the art that the present invention may be practiced without these specific details. In other instances, well known methods, procedures, components, and circuits have not been described in detail as not to unnecessarily obscure aspects of the present invention.

Figure 1:
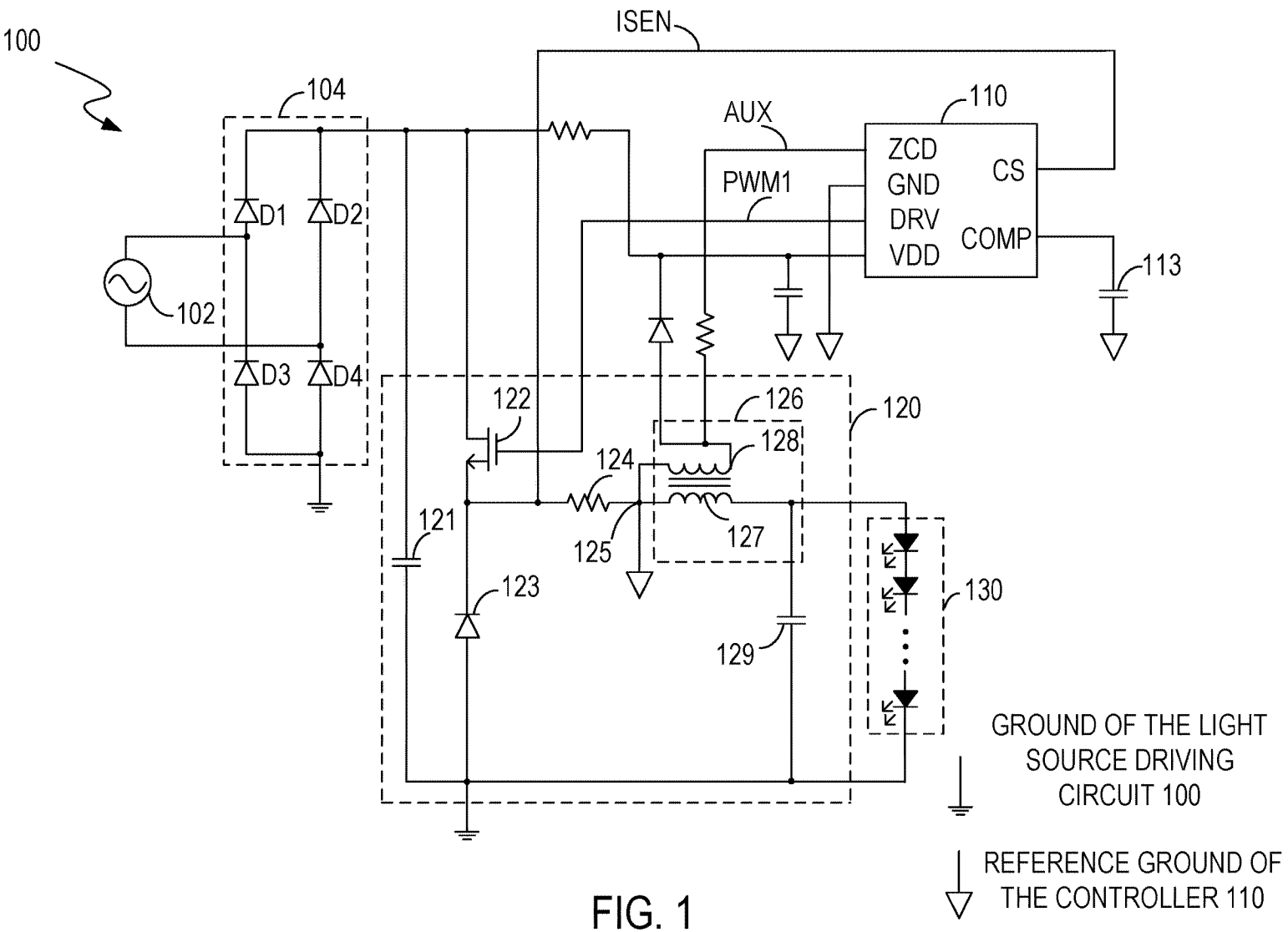
FIG. 1 is a circuit diagram illustrating a light source driving circuit, in an embodiment according to the present disclosure.

FIG. 1 is a circuit diagram illustrating driving circuit 100 for driving a light source (e.g., a LED bulb), in accordance with an embodiment of the present disclosure. In the example of FIG. 1, the light source driving circuit 100 includes a rectifier 104, a controller 110 and a power converter 120. The rectifier 104 can be a bridge rectifier including diodes D1-D4. The rectifier 104 is configured to adjust a voltage of a power source 102. The power converter 120 is configured to receive input power adjusted by the rectifier 104 and provide output power to a load (e.g., an LED string 130). The LED string 130 can be placed in a LED bulb.

In the example of FIG. 1, the power converter 120 is a buck converter. However, the power converter 120 disclosed herein can be another suitable converter (e.g., a boost converter or a buck-boost converter). The power converter 120 includes a capacitor 121, a switch 122, a diode 123, a current monitor (e.g., a resistor 124), an energy storage unit 126 (e.g., two inductors 127 and 128 which are electromagnetically coupled with each other) and a capacitor 129. A current to the energy storage unit 126 is controlled by the switch 122. In the example of FIG. 1, the current to the energy storage unit 126 is the current flowing through the inductor 127. The diode 123 is coupled between the switch 122 and the ground of the light source driving circuit 100. The capacitor 129 is coupled to the LED string 130 in parallel. In one embodiment, the inductor 127 and the inductor 128 are electromagnetically coupled to each other and connected to a common node 125. In the example of FIG. 1, the common node 125 is placed between the resistor 124 and the energy storage unit 126. In another embodiment, the common node 125 can be placed between the switch 122 and the resistor 124. The common node 125 provides the reference ground for the controller 110. In one embodiment, the reference ground of the controller 110 is different with the ground of the light source driving circuit 100. By turning on and off the switch 122, a current flowing through the inductor 127 is adjusted, to adjust the power to the LED string 130. The inductor 128 is configured to monitor the status of the inductor 127. For example, the inductor 128 can generate a detecting signal AUX to detect whether the current flowing through the inductor 127 has decreased to a predetermined current value.

The resistor 124 has one end coupled to a node between the switch 122 and the cathode of the diode 123, and the other end coupled to the inductor 127. The resistor 124 is configured to provide a sensing signal ISEN (which may be referred to herein as the second sensing signal or as the instant current sensing signal). The sensing signal ISEN can indicate an instant current flowing through the LED string 130, and an instant current flowing through the inductor 127 regardless of whether the switch 122 is turned on or is turned off. In other words, when the switch 122 is on or off, the resistor 124 can monitor the instant current flowing through the inductor 127 and the instant current flowing through the LED string 130.

The controller 110 is configured to receive the sensing signal ISEN and adjust an average current flowing through the inductor 127 to a targeted current value by turning on or off the switch 122. The capacitor 129 is configured to filter ripples of the current flowing through the LED string 130 and keep the current of the LED string 130 substantially steady and is equal to the average current flowing through the inductor 127. Therefore, the current flowing through the LED string 130 can be adjusted to be equal to the targeted current value. Here "equal to the targeted current value" is achieved without consideration of the non-ideal condition of elements and the power delivered from the inductor 128 to the controller 110.

In the example of FIG. 1, terminals of the controller 110 include a monitoring terminal ZCD, a ground terminal GND, a driving terminal DRV, a power terminal VDD, a sensing terminal CS and a compensation terminal COMP. The sensing terminal CS is coupled to the resistor 124 and is configured to receive the sensing signal ISEN indicative of the instant current flowing through the inductor 127 and the LED string 130. The compensation terminal COMP is coupled to the reference ground of the controller 110 through a capacitor 113. The compensation terminal COMP is configured to generate an error signal based on the sensing signal ISEN and a first temperature detecting signal indicating the ambient temperature of the light source driving circuit 100. The driving terminal DRV is coupled to the switch 122 and is configured to generate a driving signal to control the power converter 120. For example, the driving terminal DRV generates a pulse-width modulation signal PWM1 to turn on or off the switch 122, so as to adjust the average current flowing through the LED string 130. The monitoring terminal ZCD is coupled to the inductor 128 and is configured to receive the detecting signal AUX indicating the status of the energy storage unit 126, e.g., whether the current flowing through the inductor 127 decreases to the predetermined current value "0". In one embodiment, the detecting signal AUX can further indicate whether the LED string 130 is in an open circuit state. The power terminal VDD is coupled to the inductor 128 and is configured to receive power from the inductor 128. In the example of FIG. 1, the ground terminal GND is coupled to the common node 125 placed among the resistor 124, the inductor 127 and the inductor 128. The ground terminal GND is configured to provide reference ground of the controller 110.

The switch 122 can be an N type metal oxide semiconductor field effect transistor (N type MOSFET). The state of the switch 122 is determined by the voltage difference between the gate voltage of the switch 122 and the voltage on the ground terminal (e.g., the voltage of the common node 125). Thus, the state of the switch 122 is determined by a pulse-width modulation signal PWM1 output from the driving terminal DRV. When the switch 122 is turned on, the reference ground of the controller 110 is greater than the ground of light source driving circuit 100 which enables the circuit of the present invention to be applied to a power source with high voltage.

In operation, when the switch 122 is turned on, a current flows through the switch 122, the resistor 124, the inductor 127, and the LED string 130 to the ground of the light source driving circuit 100. When the switch 122 is turned off, a current flows through the resistor 124, the inductor 127, the LED string 130 and the diode 123. The inductor 128, coupled to the inductor 127, is configured to detect the status of the inductor 127 (e.g., based on the detecting signal AUX to detect whether the current flowing through the inductor 127 has decreased to the predetermined current value). The controller 110 monitors the instant current flowing through the inductor 127 based on the detecting signal AUX and the sensing signal ISEN. The controller 110 controls the switch 122 by the pulse-width modulation signal PWM1 to adjust the average current flowing through the inductor 127 to the targeted current value. Therefore, filtered by the capacitor 129, the current flowing through the LED string 130 is equal to the targeted current as well.

In one embodiment, the controller 110 determines whether the LED string 130 is in the open circuit state based on the detecting signal AUX. If the LED string 130 is in the open circuit state, the voltage across the capacitor 129 increases. When the switch 122 is turned off, the voltage of the inductor 127 increases as the voltage of the detecting signal AUX increases. Accordingly, the current flowing through the monitoring terminal ZCD to the controller 110 increases. As such, the controller 110 can determine whether the LED string 130 is in the open circuit state based on the voltage of the detecting signal AUX and whether the current flowing to the controller 110 is greater than a current threshold.

The controller 110 determines whether the current flowing through the inductor 127 has decreased to the predetermined current value (e.g., dropped to 0) based on the detecting signal AUX. When the driving signal (e.g., the pulse-width modulation signal PWM1) is in a first state (e.g., logic 1), the switch 122 is turned on and a current flows through the switch 122, the resistor 124, the inductor 127, and the LED string 130 to the ground of the light source driving circuit 100. Also, the current flowing through the inductor 127 starts to increase which causes the voltage of the sensing signal ISEN to increase. In one embodiment, when the switch 122 is turned on, the voltage of the detecting signal AUX is at a negative value. When the driving signal (e.g., the pulse-width modulation signal PWM1) is in a second state (e.g., logic 0), the switch 122 is turned off and the voltage of the detecting signal AUX changes to a positive value. Also, a current flows through the resistor 124, the inductor 127, the LED string 130 and the diode 123. In this case, the current flowing through the inductor 127 decreases which causes the voltage of the sensing signal ISEN to decrease. When the current flowing through the inductor 127 drops to the predetermined current value (e.g., drops to 0), a falling edge can be detected in the voltage of the detecting signal AUX.

The controller 110 determines whether the LED string 130 is in a short circuit condition based on the voltage of the power terminal VDD. If the LED string 130 is in a short circuit condition, then when the switch 122 is turned off, the voltage of the inductor 127 decreases. The voltage of the inductor 128 and the voltage at the power terminal VDD decrease accordingly. If the voltage of the power terminal VDD is less than a voltage threshold when the switch 122 is turned off, the controller 110 determines that the LED string 130 is in a short circuit condition.

The controller 110 controls the current flowing through the LED string 130 based on the ambient temperature of the light source driving circuit 100. After the ambient temperature of the light source driving circuit 100 increases to a first temperature threshold TH1 (e.g., 125° C.), if the ambient temperature keeps increasing, then the light source driving circuit 100 reduces the average current of the LED string 130 gradually. If the ambient temperature of the light source driving circuit 100 increases to a second temperature threshold TH2 (e.g., 145° C.) which is higher than the first temperature threshold, which means an overheating situation exists, then the light source driving circuit 100 keeps the switch 122 off and decreases the average current of the LED string 130 to zero quickly. The following FIG. 2A to FIG. 5 further illustrate how the controller 110 controls the current flowing through the LED string 130 based on the ambient temperature of the light source driving circuit 100.

Figure 2A:
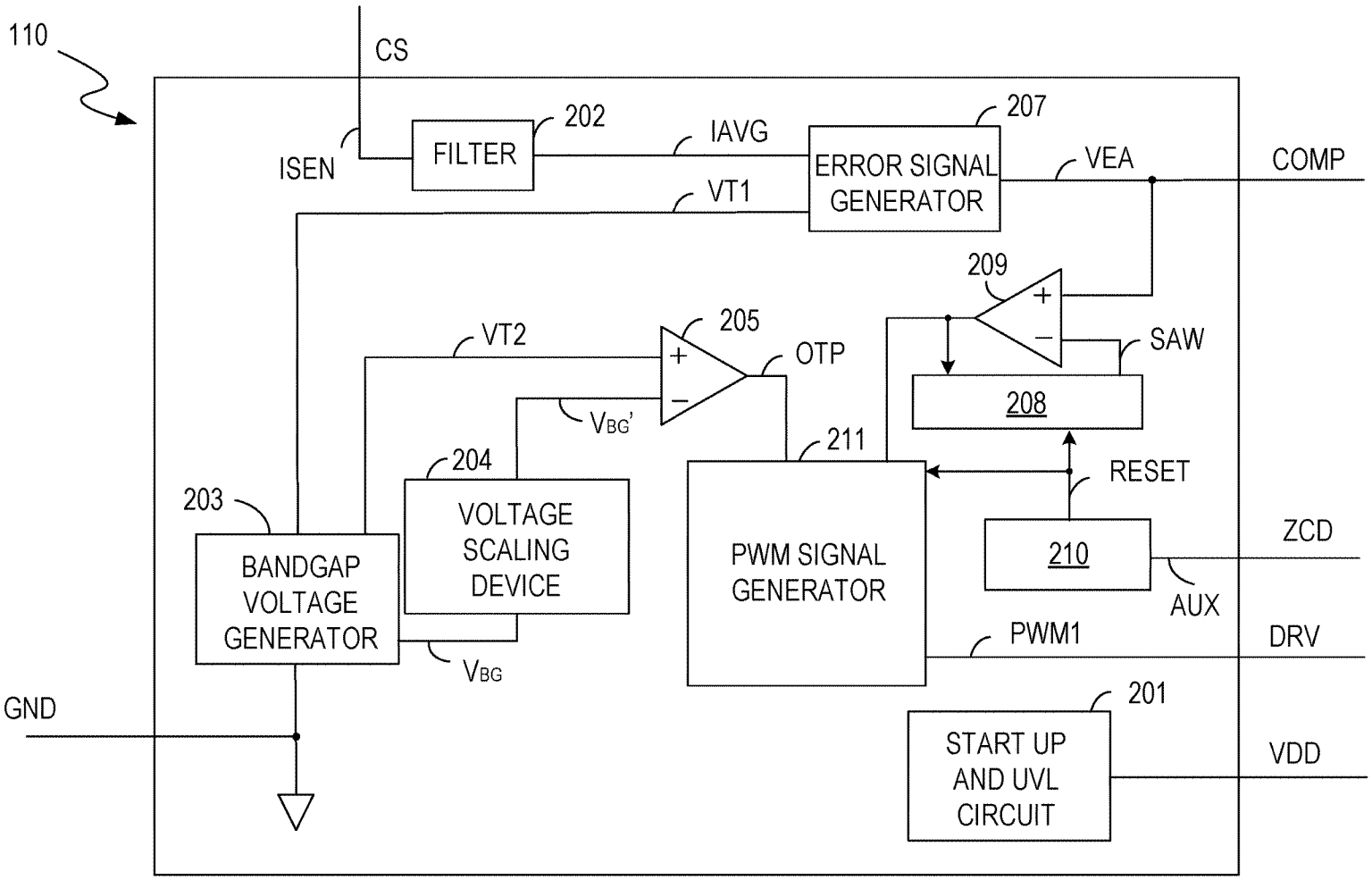
FIG. 2A is a schematic diagram of a controller in an embodiment according to the present disclosure.
Figure 2B:
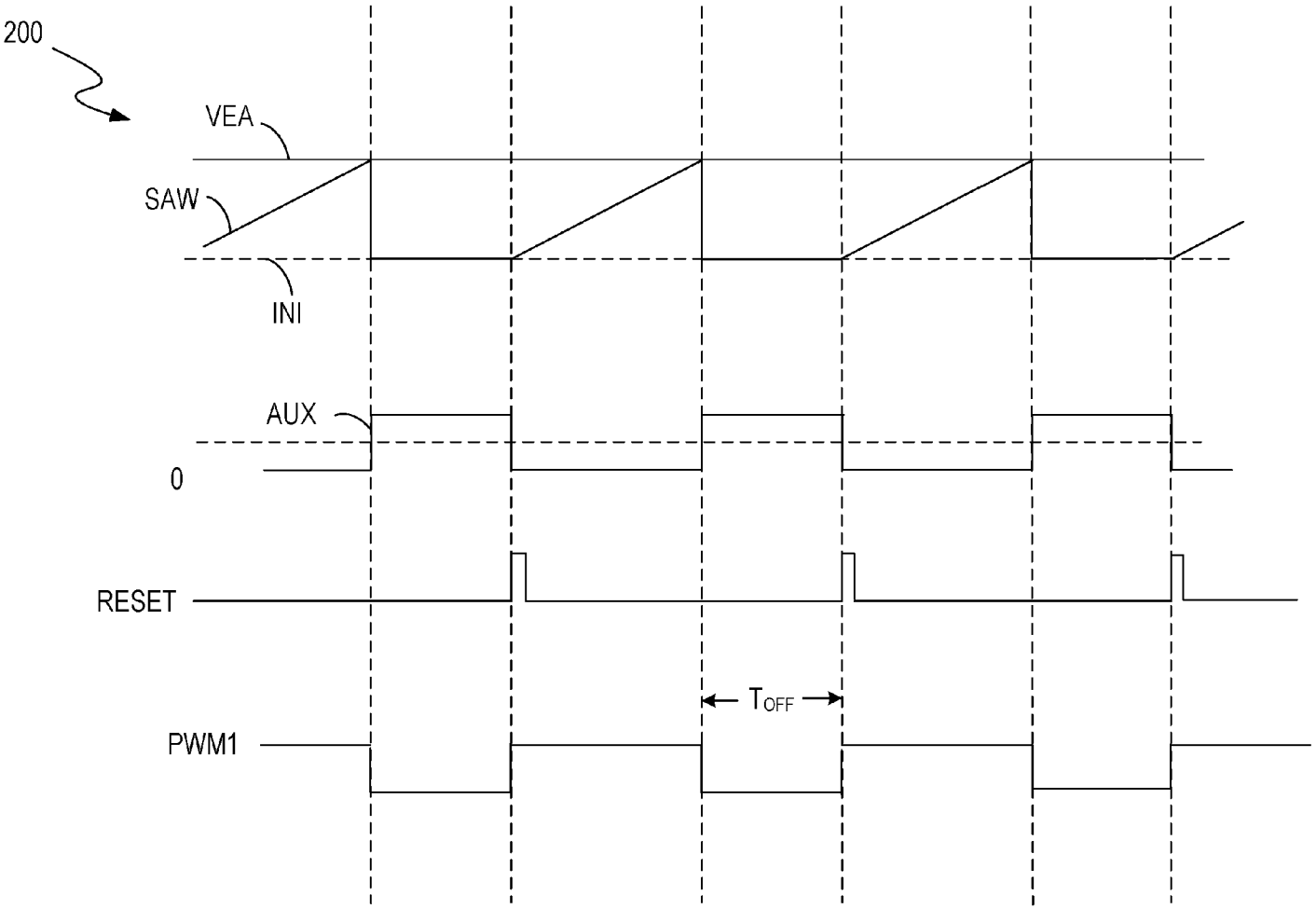
FIG. 2B is a waveform illustrating waveforms of signals received or generated by a controller in an embodiment according to the present disclosure.

FIG. 2A illustrates a schematic diagram of the controller 110 in FIG. 1. FIG. 2B illustrates waveforms of signals generated or received by the controller in FIG. 2A. Elements in FIG. 2A labeled the same in FIG. 1 have similar functions. FIG. 2A is described in combination with FIG. 1 and FIG. 2B. In the example of FIG. 2A, the controller 110 includes a start up and under voltage lockout circuit 201, a filter 202, a bandgap voltage generator 203, a voltage scaling device 204, a comparator 205, an error signal generator 207, a saw tooth signal generator 208, a comparator 209, a reset signal generator 210 and a pulse-width modulation signal generator 211.

The start up and under voltage lockout circuit 201 is coupled to the power terminal VDD and is configured to selectively start one or more components of the controller 110 based on the power status. In one embodiment, if the voltage on the power terminal VDD is greater than a first predetermined voltage, then the start up and under voltage lockout circuit 201 starts all the components of the controller 110. If the voltage on the power terminal VDD is less than a second predetermined voltage, then the start up and under voltage lockout circuit 201 shuts down all the components of the controller 110. In one embodiment, the first predetermined voltage is greater than the second predetermined voltage. The power terminal VDD is configured to supply power to the controller 110. The ground terminal GND is coupled to the reference ground of the controller 110.

The filter 202 is coupled to the monitoring terminal CS and is configured to generate a sensing signal IAVG (which may be referred to herein as the first sensing signal or as the average current sensing signal). The sensing signal IAVG indicates an average current flowing through an energy storage unit 126 (e.g., the inductor 127) and an average current flowing through a load (e.g., the LED string 130).

The bandgap voltage generator 203 is coupled to the reference ground of the controller 100 through the ground terminal GND. The bandgap voltage generator 203 is configured to generate a bandgap voltage $V_{BG}$ which is independent of temperature and to also generate a first temperature detecting signal VT1 indicative of the ambient temperature of the light source driving circuit 100. The error signal generator 207 is coupled to the bandgap voltage generator 203 and is configured to generate an error signal VEA based on the voltage difference between the first temperature detecting signal VT1 and the sensing signal IAVG. More specifically, when the ambient temperature of the light source driving circuit 100 increases, the first temperature detecting signal VT1 decreases accordingly. After the ambient environment of the light source driving circuit 100 gradually increases to a first temperature threshold TH1 (e.g., 125° C.), if the ambient temperature keeps increasing, then the error signal generator 207 decreases the voltage of the error signal VEA on the compensation terminal COMP based on the first temperature detecting signal VT1, thereby decreasing the average current flowing through the load. The saw tooth signal generator 208 is configured to generate a saw tooth signal SAW. The comparator 209 is coupled to the error signal generator 207 and the saw tooth signal generator 208. The comparator 209 is configured to compare the error signal VEA with the saw tooth signal SAW. The pulse-width modulation signal generator 211 is coupled to the comparator 209 and is configured to generate a driving signal (e.g., a pulse-width modulation signal PWM1) to control the state of the switch 122 based on an output of the comparator 209.

As discussed above, when the current flowing through the inductor 127 drops to the predetermined current value (e.g., drops to 0), a falling edge can be detected at the voltage of the detecting signal AUX. The reset signal generator 210 is coupled to the monitoring terminal ZCD and is configured to generate a reset signal RESET in response to the falling edge of the detecting signal AUX. The reset signal RESET affects the saw tooth signal generator 208 and the pulse-width modulation signal generator 211. More specifically, the reset signal RESET can switch the driving signal (e.g., the pulse-width modulation signal PWM1) to a first state (e.g., logic 1) to turn on the switch 122. In one embodiment, the pulse-width modulation signal generator 211 is coupled to the reset signal generator 210. The pulse-width modulation signal generator 211 is configured to generate the pulse-width modulation signal PWM1 to control the state of the switch 122 through a driving terminal DRV based on the output of the comparator 209 and the reset signal RESET.

In one embodiment, a duty-cycle of the pulse-width modulation signal PWM1 is determined by the error signal VEA, while the voltage of the error signal VEA is adjusted by the error signal generator 207 based on the first temperature detecting signal VT1. As discussed above, when the ambient temperature of the light source driving circuit 100 increases, the voltage of the first temperature detecting signal VT1 decreases accordingly. After the ambient environment of the light source driving circuit 100 gradually increases to the first temperature threshold TH1 (e.g., 125° C.), if the ambient temperature keeps increasing, the error signal generator 207 decreases the voltage of the error signal VEA based on the first temperature detecting signal VT1, so as to decrease the duty cycle of the pulse-width modulation signal PWM1. Accordingly, the average current flowing through the inductor 127 and the average current flowing through the LED string 130 decrease, which slows down or stops the increase of the ambient temperature of the light source driving circuit 100. As such, damage to the LED string 130 and the inner or peripheral components of the light source driving circuit 100 caused be overheating can be avoided. While the present invention is described in an example of decreasing the duty cycle of the pulse-width modulation signal PWM1, it will be understood that it is not intended to limit the present invention. On the contrary, if the ambient temperature of the light source driving circuit 100 decreases within a certain range (e.g., 145° C.-125° C.), then the error signal generator 207 can increase the voltage of the error signal VEA based on the first temperature detecting signal VT1, so as to increase the duty cycle of the pulse-width modulation signal PWM1. Accordingly, the average current flowing through the inductor 127 and the average current flowing through the LED string 130 increase.

In one embodiment, the reset signal RESET is a pulse signal with a fixed frequency. In other embodiments, the reset signal RESET is a pulse signal which is configured to maintain an off time of the switch 122 as a constant. For example, in the example of FIG. 2B, the reset signal RESET can maintain the logic 0 state time $T_{OFF}$ of the pulse-width modulation signal PWM1 constant.

In response to the reset signal RESET, the pulse-width modulation signal generator 211 generates the pulse-width modulation signal PWM1 having a first state (e.g., logic 1) to turn on the switch 122. When the switch 122 is turned on, a current flows through the switch 122, the resistor 124, the inductor 127, and the LED string 130 to the ground of the light source driving circuit 100. The saw tooth signal SAW generated by the saw tooth signal generator 208 starts to increase from an initial level INI in response to a pulse of the reset signal RESET. When the voltage of the saw tooth signal SAW increases to the voltage of the error signal VEA, the pulse-width modulation signal generator 211 generates the pulse-width modulation signal PWM1 having a second state (e.g., logic 0) to turn off the switch 122. The saw tooth signal SAW is reset to the initial level INI until the next pulse of the reset signal RESET is received by the saw tooth signal generator 208. The saw tooth signal SAW starts to increase from the initial level INI again when the next pulse in the reset signal RESET arrives.

The bandgap voltage generator 203 further generates a second temperature detecting signal VT2 indicating the ambient temperature of the light source driving circuit 100. The voltage scaling device 204 is coupled to the bandgap voltage generator 203 and is configured to convert the bandgap voltage $V_{BG}$ to a suitable reference voltage $V_{BG}'$ (e.g., by decreasing the bandgap voltage $V_{BG}$ in proportion). The comparator 205 is coupled to the bandgap voltage generator 203 and the voltage scaling device 204. The comparator 205 is configured to compare the second temperature detecting signal VT2 with the reference voltage $V_{BG}'$ to generate an overheating signal OTP. The overheating signal OTP can indicate whether an overheating situation is occurring. More specifically, when the ambient temperature of the light source driving circuit 100 is less than or equal to a second temperature threshold (e.g., 145° C.), the voltage of the second temperature detecting signal VT2 is greater than the reference voltage $V_{BG}'$. Thus, the comparator 205 generates the overheating signal OTP having a first state (e.g., logic 1) which enables the pulse-width modulation signal generator 211 to generate a driving signal (e.g., the pulse-width modulation signal PWM1) to turn on a switch 122 at a terminal DRV under control of a comparator 209 or/and a reset signal generator 210. When the ambient temperature of the light source driving circuit 100 is greater than the second temperature threshold (e.g., 145° C., indication of overheating), the voltage of the second temperature detecting signal VT2 is less than the reference voltage $V_{BG}'$. Thus, the comparator 205 generates the overheating signal OTP having a second state (e.g., logic 0) which enables the pulse-width modulation signal generator 211 to maintain the driving signal (e.g., the pulse-width modulation signal PWM1) at a particular state (e.g., logic 0) to keep the switch 122 off, so as to cut down the current flowing through the LED string 130. As such, damage to the LED string 130 and the inner or peripheral components of the light source driving circuit 100 caused by overheating can be avoided.

Figure 3:
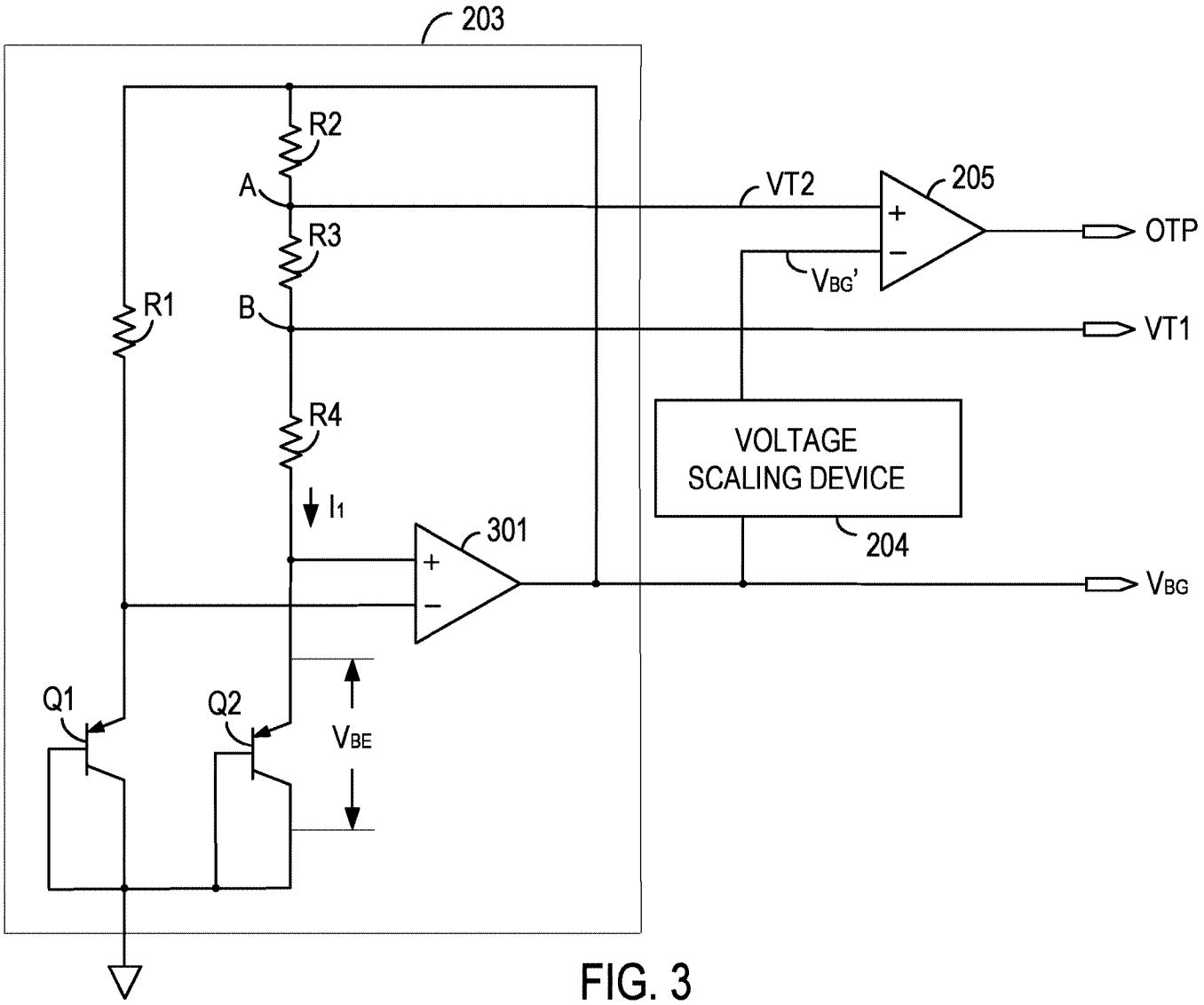
FIG. 3 is a schematic diagram of a bandgap voltage generator in an embodiment according to the present disclosure.

FIG. 3 is a schematic diagram of the bandgap voltage generator 203 in FIG. 2A. Elements labeled the same in FIG. 2A have similar functions. FIG. 3 is described in combination with FIG. 2A. The bandgap voltage generator 203 includes resistors R1-R4, transistors Q1 and Q2 and an operational amplifier 301. The resistor R1 and the transistor Q1 form a first voltage stabilizing circuit. The resistor R2, the resistor R3, the resistor R4 and the transistor Q2 form a second voltage stabilizing circuit. As shown in FIG. 3, the first voltage stabilizing circuit and the second voltage stabilizing circuit are coupled to two input terminals of the operational amplifier 301 and generate a bandgap voltage $V_{BG}$ which is independent of an ambient temperature of a light source driving circuit 100 at an output terminal of the operational amplifier 301. The bandgap voltage $V_{BG}$ is provided to a common node between the voltage scaling device 204 and the resistor R2.

A voltage of a common node B between the resistor R3 and the resistor R4 is labeled as a first temperature detecting signal VT1 indicating the ambient temperature of the light source driving circuit 100. As shown in FIG. 3, the voltage of the first temperature detecting signal VT1 equals the sum of a voltage $V_{BE}$ between the base and the emitter of the transistor Q2 and the voltage of the resistor R4. That is, the voltage of VT1 equals $V_{BE}$+r4*$I_1$, where r4 is the resistance of the resistor R4, and $I_1$ is the value of a current flowing through the resistor R4. The voltage $V_{BE}$ has a negative temperature characteristic which means the voltage $V_{BE}$ decreases with an increase of the ambient temperature. Therefore, the first temperature detecting signal VT1 in the second voltage stabilizing circuit decreases as the ambient temperature increases. As discussed above, in the controller 110 of the light source driving circuit 100, an error signal generator 207 adjusts a voltage of an error signal VEA based on the first temperature detecting signal VT1. After the ambient temperature of the light source driving circuit 100 increases to a first temperature threshold TH1 (e.g., 125° C.), if the ambient temperature continues increasing, the first temperature detecting signal VT1 decreases. Then the error signal generator 207 decreases the voltage of the error signal VEA to decrease a duty cycle of a pulse-width modulation signal PWM1, so as to decrease an average current flowing through a LED string 130.

Also, a voltage of a common node A between the resistor R2 and the resistor R3 is labeled as a second temperature detecting signal VT2 indicating the ambient temperature of the light source driving circuit 100. The voltage scaling device 204 is coupled to the bandgap voltage generator 203 and is configured to convert the bandgap voltage $V_{BG}$ to a reference voltage $V_{BG}'$ (e.g., by decreasing the bandgap voltage $V_{BG}$ in proportion). The second temperature detecting signal VT2 and the reference voltage $V_{BG}'$ are outputted to two input terminals of a comparator 205 respectively to generate an overheating signal OTP. When the ambient temperature of the light source driving circuit 100 is less than or equal to a second temperature threshold (e.g., 145° C.), the voltage of the second temperature detecting signal VT2 is greater than the reference voltage $V_{BG}'$. Thus, the comparator 205 generates the overheating signal OTP having a first state (e.g., logic 1) under control of a comparator 209 or/and a reset signal generator 210. The overheating signal OTP having the first state enables the pulse-width modulation signal generator 211 to generate a driving signal (e.g., the pulse-width modulation signal PWM1) at the terminal DRV to control a switch 122. When the ambient temperature of the light source driving circuit 100 is greater than the second temperature threshold (e.g., 145° C., indication of overheating), the voltage of the second temperature detecting signal VT2 is less than the reference voltage $V_{BG}'$. Thus, the comparator 205 generates the overheating signal OTP having a second state (e.g., logic 0) which enables the pulse-width modulation signal generator 211 to maintain the driving signal (e.g., the pulse-width modulation signal PWM1) at a particular state (e.g., logic 0) to keep the switch 122 in the off state, so as to cut off the current flowing through the LED string 130.

The structure of the bandgap voltage generator 203 discussed above is just one possible embodiment and is for illustrative purposes, and does not limit the present invention to its use. On the contrary, the present invention is intended to cover other suitable alternatives, modifications and equivalents of the bandgap voltage generator 203.

Figure 4:
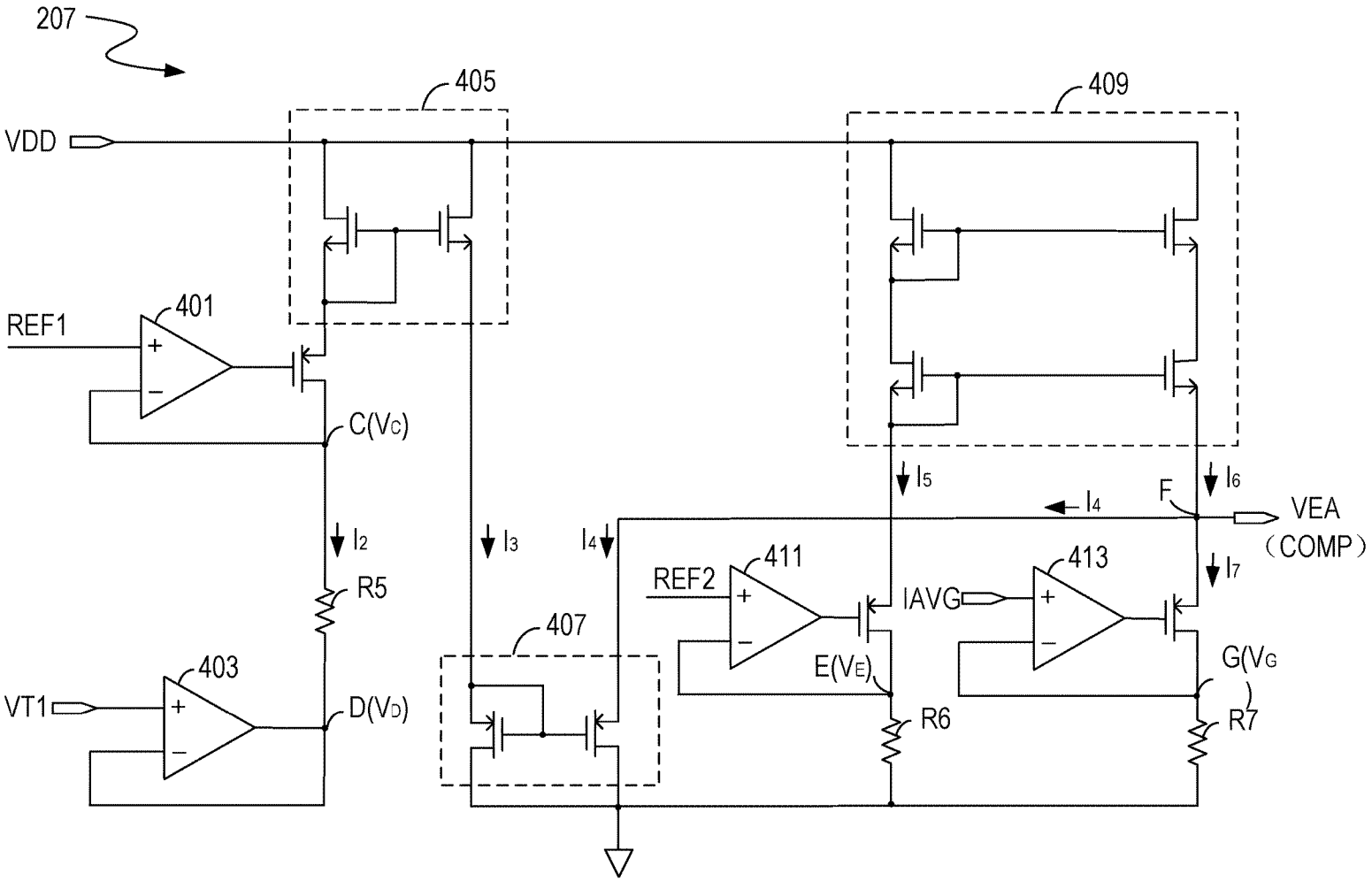
FIG. 4 is a schematic diagram of an error signal generator in an embodiment according to the present disclosure.

FIG. 4 is a schematic diagram of an error signal generator 207 in FIG. 2A. FIG. 4 is described in combination with FIG. 2A. The error signal generator 207 includes an operational amplifier 401, an operational amplifier 403, a current mirror 405, a current mirror 407, a current mirror 409, an operational amplifier 411, an operational amplifier 413, and resistors R5-R7. In steady operation, a signal at the positive terminal of an ideal operational amplifier is the same as the one at the negative terminal. Thus, as shown in FIG. 4, a voltage $V_C$ at the common mode C is equal to a reference voltage REF1 (a predetermined constant value). A voltage $V_D$ at the common mode D is equal to the voltage of a first temperature detecting signal VT1. The voltage of the first temperature detecting signal VT1 decreases as the ambient temperature of a light source driving circuit 100 increases. Before the ambient temperature of the light source driving circuit 100 increases to a first temperature threshold TH1 (e.g., 125□), the voltage $V_D$ is greater than the voltage $V_C$. Thus, the decrease of the voltage of the first temperature detecting signal VT1 will not cause an increase in a current $I_2$. After the ambient temperature of the light source driving circuit 100 increases to the first temperature threshold TH1 (e.g., 125□), the voltage $V_D$ is less than the voltage $V_C$. As the voltage difference across the resistor R5 increases, a current $I_2$ flowing through the resistor R5 increases accordingly. The current mirror copies the current flowing through an input path to an output path. Thus, due to the current mirror 405 and the current mirror 407, a current $I_3$ and a current $I_4$ increase when the ambient temperature rises.

Similarly, a voltage $V_E$ at the common node E, which is coupled to one end of the resistor R6, is equal to a reference voltage REF2 (a predetermined constant value). The other end of the resistor R6 is coupled to the reference ground of a controller 110. Thus, the voltage difference on the resistor R6 is constant. A current $I_5$ flowing through the resistor R5 is constant as well. Also, because of the current mirror 409, a current $I_6$ is constant. Thus, in a condition where the current $I_6$ is constant while the current $I_4$ increases, a voltage of an error signal VEA outputted at a compensation terminal COMP decreases. As discussed above, decreasing the voltage of the error signal VEA can cause an average current flowing through a LED string 130 to decrease, and the voltage of the sensing signal IAVG also decreases. With the influence of the operational amplifier 413, the voltage difference $V_G$ of the resistor R7 decreases which leads to decreasing the current $I_7$ flowing through the resistor R7 to achieve a current balance. Because of the decrease of the average current flowing through the LED string 130, the rise of the ambient temperature of the light source driving circuit 100 is slowed down or stopped. As such, the ambient temperature of the light source driving circuit 100 is under effective control.

Figure 5:
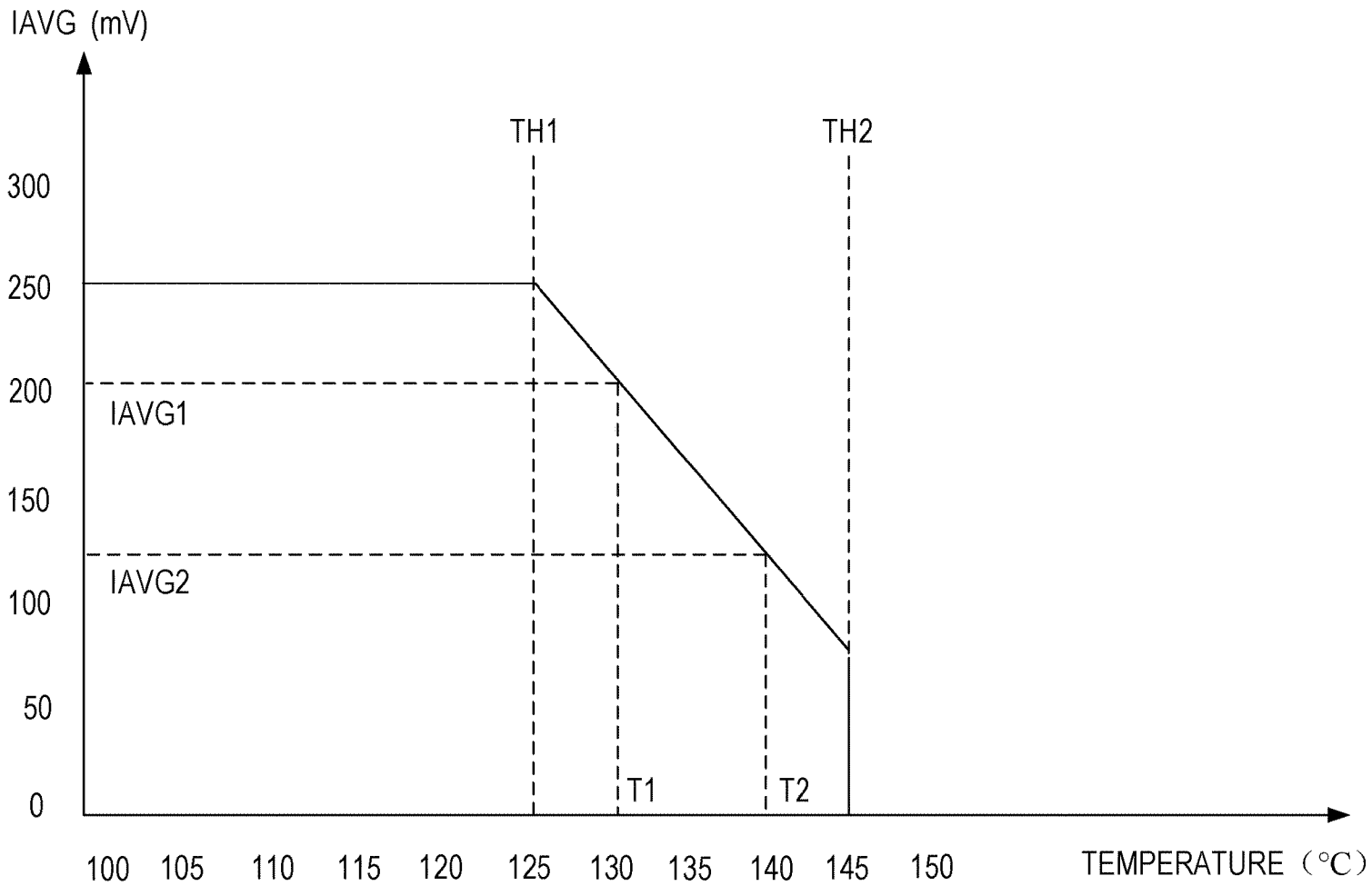
FIG. 5 is a waveform illustrating a sensing signal IAVG which indicates an average current flowing through a light source as a function of ambient temperature in an embodiment according to the present disclosure.

FIG. 5 is a waveform illustrating the sensing signal IAVG in FIG. 4 versus ambient temperature. In the examples of FIG. 4 and FIG. 5, according to the circuit structure of an error signal generator 207, before the ambient temperature of a light source driving circuit 100 increases to a first temperature threshold TH1 (e.g., 125° C.), voltage $V_D$ is greater than the voltage $V_C$. Thus, decreasing the voltage of a first temperature detecting signal VT1 does not cause a change to the voltage of the sensing signal IAVG. In other words, when the ambient temperature of the light source driving circuit 100 is less than the first temperature threshold TH1, a controller 100 maintains an average current flowing through a LED string 130 at a predetermined value such that the average current does not vary with the ambient temperature. After the ambient temperature of the light source driving circuit 100 increases to the first temperature threshold (e.g., 125° C.), if the ambient temperature continues rising, the error signal generator 207 decreases a voltage of an error signal VEA based on the first temperature detecting signal VT1 and the sensing signal IAVG (the voltage of the error signal VEA is inversely proportional to the ambient temperature), so as to decrease a duty cycle of a pulse-width modulation signal PWM1. Thus, the average current flowing through the inductor 127 decreases. The voltage of the sensing signal IAVG decreases accordingly. As such, the rise of the ambient temperature of the light source driving circuit 100 is slowed down or stopped. For example, if the ambient temperature of the light source driving circuit 100 is between the first temperature threshold TH1 and a second temperature threshold TH2, when the ambient temperature of the light source driving circuit 100 increases from a first temperature T1 to a second temperature T2, the average current flowing through the LED string 130 decreases from a first current to a second current under control of the controller 110. Therefore, the voltage of the sensing signal IAVG drops from a first level IAVG1 to a second level IAVG2. The second level IAVG2 can be greater than 0. In other words, when the ambient temperature is between the first temperature threshold TH1 and the second temperature threshold TH2, the controller 110 adjusts the average current flowing through the LED strings 130 to make the average current inversely proportional to the ambient temperature. After the ambient temperature of the light source driving circuit 100 exceeds a second temperature threshold TH2 (e.g., 145° C.), the comparator 205 in the controller 110 generates an overheating signal OTP having a second state (e.g., logic 0) which enables the pulse-width modulation signal generator 211 to maintain a driving signal (e.g., the pulse-width modulation signal PWM1) at a predetermined state (e.g., logic 0) at the driving terminal DRV to keep the switch 122 off, so as to cut off a current flowing through the LED string 130. Accordingly, the voltage of the sensing signal IAVG decreases rapidly (e.g., drops to 0).

The waveform shown in FIG. 5 is not intend to limit the present invention. On the contrary, the present invention covers various kinds of error signal generators that may lead to different waveforms for the sensing signal IAVG.

Figure 6:
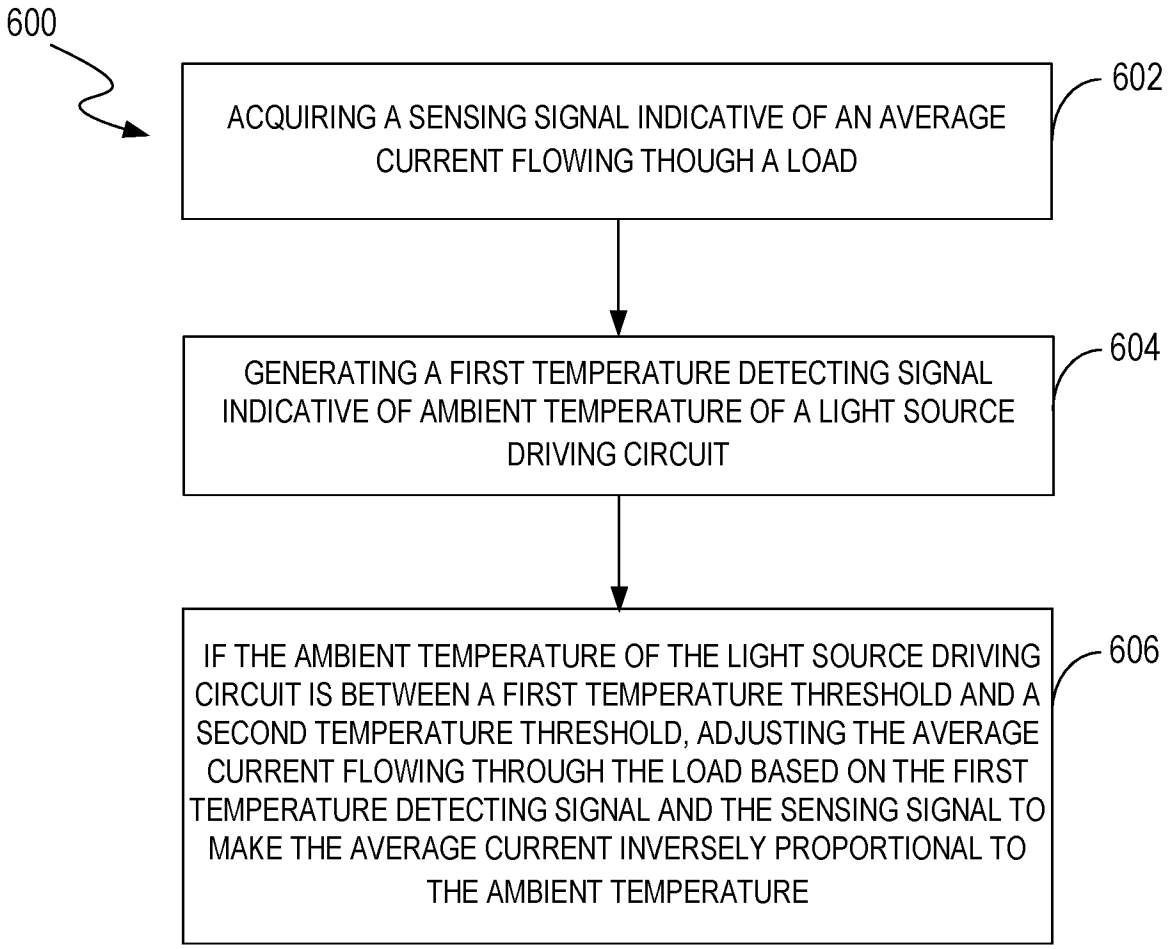
FIG. 6 is a flowchart illustrating a method for controlling a light source driving circuit, in an embodiment according to the present disclosure.

FIG. 6 is a flowchart 600 illustrating a method for controlling a light source driving circuit (such as the light source driving circuit 100 for driving the LED string 130), in accordance with an embodiment of the present disclosure. FIG. 6 is described in combination with FIG. 1-FIG. 5.

In block 602, a sensing signal IAVG which indicates an average current flowing through a load (e.g., the LED string 130) is acquired. The sensing signal IAVG can be acquired based on a sensing signal ISEN indicative of an instant current flowing through the load and an instant current flowing through an energy storage unit.

In block of 604, a first temperature detecting signal VT1 indicative of an ambient temperature of the light source driving circuit 100 is generated. More specifically, the bandgap voltage generator 203 in the FIG. 3 generates the first temperature detecting signal VT1. With an increase in the ambient temperature of the light source driving circuit 100, a voltage of the first temperature detecting signal VT1 decreases.

In block of 606, if the ambient temperature of the light source driving circuit is between a first temperature threshold TH1 and a second temperature threshold TH2, the average current flowing through the load is adjusted based on the first temperature detecting signal VT1 and the sensing signal IAVG, so that the average current is inversely proportional to the ambient temperature. More specifically, an error signal generator 207 generates an error signal VEA based on the sensing signal IAVG and the first temperature detecting signal VT1. After the ambient temperature of the light source driving circuit 100 rises to the first temperature threshold TH1 (e.g., 125° C.), if the ambient temperature continues to increase, then the error signal generator 207 decreases a voltage of the error signal VEA on an compensation terminal COMP based on the sensing signal IAVG and the first temperature detecting signal VT1. A pulse-width modulation signal generator 211 adjusts the average current flowing through the load based on the error signal VEA. In one embodiment, the pulse-width modulation signal generator 211 adjusts the average current flowing through the load by adjusting a duty cycle of a pulse-width modulation signal PWM1 based on the error signal VEA. For example, after the ambient temperature of the light source driving circuit 100 rises to the first temperature threshold (e.g., 125° C.), if the ambient temperature keeps increasing, the error signal generator 207 decreases the voltage of the error signal VEA based on the first temperature detecting signal VT1, so as to decrease the duty cycle of the pulse-width modulation signal PWM1. Therefore, the average current flowing through the inductor 127 and the average current flowing through the load decrease. The rise of the average temperature of the light source driving circuit 100 is slowed down or stopped.

In an embodiment, the method further includes: if the ambient temperature of the light source driving circuit 100 is greater than the second temperature threshold TH2 (e.g., 145° C.), an overheating signal OTP having a second state (e.g., logic 0) is generated based on a second temperature detecting signal VT2, which enables the pulse-width modulation signal generator 211 to maintain a driving signal (e.g., the pulse-width modulation signal PWM1) at a terminal DRV at a particular state (e.g., logic 0) to turn off the switch 122. Therefore, the current flowing through the LED string 130 is cut off.

Figure 7:
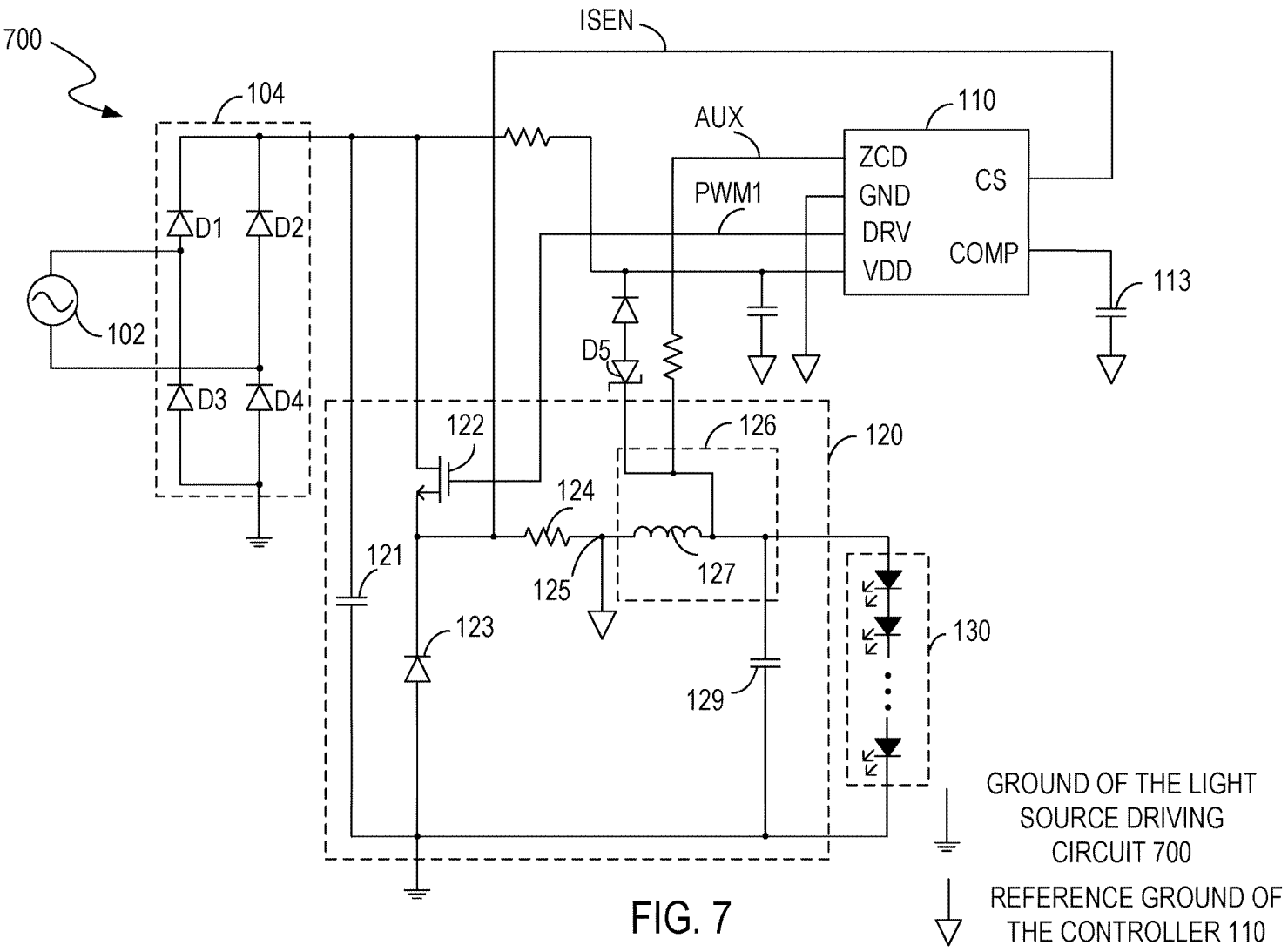
FIG. 7 is a circuit diagram illustrating a light source driving circuit, in an embodiment according to the present disclosure.

FIG. 7 is a circuit diagram illustrating a light source driving circuit 700, in accordance with another embodiment of the present disclosure. Elements labeled the same as in FIG. 1 have similar functions. The light source driving circuit 700 is similar with the light source driving circuit 100 except for the structure of the power converter 120. In the example of FIG. 7, the energy storage unit 126 only includes an inductor 127. The inductor 127 has one end coupled to a monitoring terminal ZCD for providing a detecting signal AUX. The detecting signal AUX indicates whether a current flowing through the inductor 127 has decreased to a predetermined current value. In an embodiment, the light source driving circuit 700 includes a voltage level shifter such as a Zener diode D5 coupled between the inductor 127 and a controller 110. The Zener diode D5 is configured to act as a bias voltage level shifter to add bias voltage to the controller 110, so as to provide suitable power from the inductor 127 to the controller 110 through a power terminal VDD. In another embodiment, the Zener diode D5 can be replaced by another kind of element, such as a resistor. In another embodiment, the light source driving circuit 700 does not include a voltage level shifter.

Advantageously, the light source driving circuit, the controller and the control method of the present invention can help effectively avoid the damage to LED strings and the inner or peripheral components of the light source driving circuit caused by overheating.

While the foregoing description and drawings represent embodiments of the present invention, it will be understood that various additions, modifications and substitutions may be made therein without departing from the spirit and scope of the principles of the present invention as defined in the accompanying claims. One skilled in the art will appreciate that the invention may be used with many modifications of form, structure, arrangement, proportions, materials, elements, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims and their legal equivalents, and not limited to the foregoing description.

What is claimed is:

1. A light source driving circuit, comprising:

a power converter configured for receiving input voltage and providing output power to a load; and a controller, coupled to the power converter, configured for acquiring a first sensing signal indicative of an average current flowing through the load, generating a first temperature detecting signal indicative of an ambient temperature of the light source driving circuit and adjusting the average current flowing through the load based on the first temperature detecting signal and the first sensing signal, wherein the controller decreases the average current of the load based on the first temperature detecting signal and the first sensing signal when the ambient temperature of the light source driving circuit keeps rising after the ambient temperature rises above a first temperature threshold, wherein the power converter comprises:

a current monitor configured for providing a second sensing signal indicative of an instant current flowing through the load, wherein the first sensing signal is acquired based on the second sensing signal; and a switch, coupled to the current monitor, wherein the controller generates a driving signal to control the switch based on the first temperature detecting signal and the first sensing signal, wherein the controller comprises:

a bandgap voltage generator, configured for generating the first temperature detecting signal;

an error signal generator, coupled to the bandgap voltage generator, configured for generating an error signal based on the first temperature detecting signal and the first sensing signal;

a saw-tooth signal generator, configured for generating a saw tooth signal;

a first comparator, coupled to the error signal generator and the saw-tooth signal generator, configured for comparing the error signal and the saw-tooth signal; and a pulse-width modulation signal generator, coupled to the first comparator, configured for generating the driving signal based on an output of the first comparator, and wherein when the ambient temperature of the light source driving circuit is greater than the first temperature threshold, then a voltage of the error signal decreases in response to a rise of the ambient temperature of the light source driving circuit, and the driving signal controls the switch to decrease the average current flowing through the load.

2. The light source driving circuit of claim 1, wherein the controller maintains the average current flowing through the load at a predetermined value when the ambient temperature of the light source driving circuit is less than or equal to the first temperature threshold.

3. The light source driving circuit of claim 1, wherein the controller adjusts the average current flowing through the load from a first current value to a second current value based on the first temperature detecting signal and the first sensing signal when the ambient temperature is greater than the first temperature threshold and less than a second temperature threshold and the ambient temperature increases from a first temperature value to a second temperature value, and wherein the second current value is greater than zero.

4. The light source driving circuit of claim 1, wherein the bandgap voltage generator is further configured for generating a second temperature detecting signal indicative of the ambient temperature of the light source driving circuit and the first temperature detecting signal, wherein the controller further comprises:

a second comparator, coupled to the bandgap voltage generator, configured for generating an overheating signal based on a reference voltage and the second temperature detecting signal, wherein the overheating signal keeps the switch off when the ambient temperature of the light source driving circuit is greater than a second temperature threshold, and wherein the second temperature threshold is greater than the first temperature threshold.

5. The light source driving circuit of claim 4, wherein the bandgap voltage generator is further configured for generating a bandgap voltage, and wherein the controller further comprises a voltage scaling device, coupled to the bandgap voltage generator and the second comparator, configured for converting the bandgap voltage to the reference voltage, and wherein the voltage of the second temperature detecting signal is greater than the reference voltage when the ambient temperature of the light source driving circuit is less than or equal to the second temperature threshold, and the voltage of the second temperature detecting signal is less than the reference voltage when the ambient temperature of the light source driving circuit is greater than the second temperature threshold.

6. The light source driving circuit of claim 1, wherein the power converter further comprises an energy storage unit coupled to the current monitor, wherein a current flowing through the energy storage unit is controlled by the switch.

7. The light source driving circuit of claim 6, wherein the energy storage unit comprises:

a first inductor, wherein the current of the energy storage unit flows through the first inductor, and a second inductor, electromagnetically coupled to the first inductor, configured for monitoring status of the first inductor.

8. The light source driving circuit of claim 6, wherein the energy storage unit comprises a first inductor, wherein the current of the energy storage unit flows through the first inductor, and wherein the power converter further comprises a Zener diode coupled between the first inductor and the controller.

9. The light source driving circuit of claim 6, wherein the controller is configured for receiving a detecting signal indicating the status of the energy storage unit, and wherein the controller turns on the switch when the detecting signal indicates that the current flowing through the energy storage unit decreases to a predetermined value.

10. A controller, for controlling ambient temperature of a light source driving circuit having a power converter, the power converter configured for receiving an input voltage and supplying power to a load, the controller comprising:

a sensing terminal, configured for receiving an instant current sensing signal indicative of an instant current flowing through the load;

a compensation terminal, configured for generating an error signal based on the instant current sensing signal and a first temperature detecting signal indicative of an ambient temperature of the light source driving circuit; and a driving terminal, configured for generating a driving signal based on the error signal to control the power converter and adjust an average current flowing through the load, wherein the driving signal decreases the average current flowing through the load when the ambient temperature of the light source driving circuit keeps rising after the ambient temperature rises above a first temperature threshold, wherein the controller further comprises:

a bandgap voltage generator, configured for generating the first temperature detecting signal;

a filter configured for generating an average current sensing signal indicative of an average current flowing through the load based on the first temperature detecting signal;

an error signal generator, coupled to the bandgap voltage generator, configured for generating the error signal based on the first temperature detecting signal and the average current sensing signal;

a saw tooth signal generator configured for generating a saw tooth signal;

a first comparator, coupled to the error signal generator and the saw tooth signal generator, configured for comparing the error signal with the saw tooth signal; and a pulse-width modulation signal generator, coupled to the first comparator, configured for generating the driving signal based on an output of the first comparator, wherein a voltage of the error signal is inversely proportional to the ambient temperature of the light source driving circuit when the ambient temperature of the light source driving circuit is greater than a first temperature threshold.

11. The controller of claim 10, wherein the bandgap voltage generator is further configured for generating a bandgap voltage and a second temperature detecting signal which indicates the ambient temperature of the light source driving circuit, wherein the controller further comprises:

a voltage scaling device, coupled to the bandgap voltage generator, configured for converting the bandgap voltage to a reference voltage, wherein a voltage of the second temperature detecting signal is greater than the reference voltage when the ambient temperature of the light source driving circuit is less than or equal to the a second temperature threshold, and wherein the second temperature threshold is greater than the first temperature threshold, and wherein the voltage of the second temperature detecting signal is less than the reference voltage when the ambient temperature of the light source driving circuit is greater than the second temperature threshold; and a second comparator, coupled to the bandgap voltage generator and the voltage scaling device, configured for generating an overheating signal based on the reference voltage and the second temperature detecting signal, wherein the controller cuts off a current flowing through the load based on the overheating signal when the ambient temperature of the light source driving circuit is greater than the second temperature threshold.

12. The controller of claim 10, further comprising:

a monitoring terminal, configured for receiving a detecting signal which indicates status of an energy storage unit in the power converter, wherein a current flowing through the energy storage unit is controlled by the driving signal, and the driving signal has a first state and a second state, and wherein the current flowing through the energy storage unit increases when the driving signal is in the first state, and wherein the current flowing through the energy storage unit decreases when the driving signal is in the second state.

13. The controller of claim 12, wherein the controller adjusts the driving signal to the first state when the detecting signal indicates that the current flowing through the energy storage unit decreases to a predetermined value.

14. A method for powering a load by a light source driving circuit including a power converter, comprising:

acquiring a first sensing signal indicative of an average current flowing through the load;

generating a first temperature detecting signal indicative of an ambient temperature of the light source driving circuit;

adjusting the average current flowing through the load based on the first temperature detecting signal and the first sensing signal to make the average current flowing through the load inversely proportional to the ambient temperature of the light source driving circuit when the ambient temperature of the light source driving circuit is between a first temperature threshold and a second temperature threshold which is greater than the first temperature threshold;

generating a second temperature detecting signal indicative of the ambient temperature the light source driving circuit, the first temperature detecting signal and a bandgap voltage by a bandgap voltage generator;

generating an overheating signal based on the bandgap voltage and the second temperature detecting signal; and cutting off a current flowing through the load based on the overheating signal when the ambient temperature of the light source driving circuit is greater than the second temperature threshold.

15. The method of claim 14, further comprising:

maintaining the average current at a predetermined value when the ambient temperature of the light source driving circuit is less than the first temperature threshold.

16. The method of claim 14, wherein the step of adjusting the average current flowing through the load based on the first temperature detecting signal and the first sensing signal comprises:

generating an error signal based on the first temperature detecting signal and the first sensing signal; and generating a driving signal based on the error signal and a saw tooth signal, wherein a voltage of the error signal is inversely proportional to the ambient temperature of the light source driving circuit when the ambient temperature of the light source driving circuit is between the first temperature threshold and the second temperature threshold.

17. The method of claim 14, further comprising:

generating a driving signal based on the first temperature detecting signal and the first sensing signal to adjust the average current flowing through the load, wherein the driving signal has a first state and a second state, and a current flowing through an energy storage unit in the power converter increases when the driving signal is at the first state, and the current flowing through the energy storage unit decreases when the driving signal is at the second state;

generating a detecting signal indicative of a status of the energy storage unit; and adjusting the driving signal to the first state when the detecting signal indicates that the current flowing through the energy storage unit decreases to a predetermined value.

* * * * *